US009670929B2

(12) United States Patent
Malone

(10) Patent No.: US 9,670,929 B2
(45) Date of Patent: Jun. 6, 2017

(54) METHODS AND SYSTEM FOR DETECTING TURBOCHARGER DEGRADATION

(71) Applicant: General Electric Company, Schenectady, NY (US)

(72) Inventor: Matthew John Malone, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 963 days.

(21) Appl. No.: 13/741,613

(22) Filed: Jan. 15, 2013

(65) Prior Publication Data

US 2014/0199155 A1 Jul. 17, 2014

(51) Int. Cl.

| | |
|---|---|
| ***F04D 15/00*** | (2006.01) |
| ***F04D 25/02*** | (2006.01) |
| ***F04D 27/00*** | (2006.01) |
| ***F01D 15/02*** | (2006.01) |
| ***F01D 17/06*** | (2006.01) |
| ***F01D 21/04*** | (2006.01) |

(52) U.S. Cl.

CPC ..... *F04D 15/00* (2013.01); *F01D 15/02* (2013.01); *F01D 17/06* (2013.01); *F01D 21/04* (2013.01); *F04D 25/024* (2013.01); *F04D 27/001* (2013.01); *F05D 2220/40* (2013.01); *F05D 2270/09* (2013.01); *F05D 2270/304* (2013.01); *F05D 2270/821* (2013.01)

(58) Field of Classification Search

CPC ..... F01D 21/003; F01D 21/04; F01D 21/06; F01D 21/08; F01D 15/02; F01D 17/06; F05D 2220/40; F05D 2270/821; F05D 2270/09; F05D 2270/304; F04D 15/00; F04D 27/001; F04D 25/024

See application file for complete search history.

(56) References Cited

U.S. PATENT DOCUMENTS

| | | | | |
|---|---|---|---|---|
| 6,209,390 | B1 | 4/2001 | LaRue et al. | |
| 2006/0185445 | A1* | 8/2006 | Delcher | F01D 21/003 73/862.325 |
| 2009/0232638 | A1* | 9/2009 | Swenson | F01D 21/04 415/118 |
| 2009/0266073 | A1 | 10/2009 | Greentree | |
| 2010/0292937 | A1 | 11/2010 | Hosny et al. | |

FOREIGN PATENT DOCUMENTS

WO 2011/131828 A1 10/2011

OTHER PUBLICATIONS

Office Action issued in connection with corresponding AU Application 2014200173 dated Oct. 18, 2016.

* cited by examiner

*Primary Examiner* — Dwayne J White
*Assistant Examiner* — Adam W Brown
(74) *Attorney, Agent, or Firm* — Global Patent Operation; John A. Kramer

(57) ABSTRACT

Various methods and systems are provided for detecting turbocharger degradation. In one example, a method comprises detecting an axial position of a turbine rotor based on output from a turbine speed sensor, and if the axial position is greater than a threshold distance from a base position, indicating turbocharger degradation.

17 Claims, 5 Drawing Sheets

METHODS AND SYSTEM FOR DETECTING TURBOCHARGER DEGRADATION

FIELD

Embodiments of the subject matter disclosed herein relate to a turbocharger coupled to an internal combustion engine.

BACKGROUND

Turbochargers are devices used to increase the power output of an engine by compressing air into the engine with a compressor driven by a turbine that harvests energy from the hot engine exhaust gases. Turbochargers often operate at very high speeds (e.g., 25,000 RPM) and thus degradation of the turbocharger during high speed operation may result in catastrophic damage. One or more sensors may be used to monitor turbocharger function, and if degradation is indicated, the engine may be shut down. However, some types of turbocharger degradation may be difficult to detect. Further, the turbocharger sensors themselves may be prone to degradation.

BRIEF DESCRIPTION

In one embodiment, a method comprises detecting an axial position of a turbine rotor based on output from a turbine speed sensor, and if the axial position is greater than a threshold distance from a base position, indicating turbocharger degradation. In this way, turbocharger degradation may be determined based on output from a turbine speed sensor.

In an embodiment, a method comprises receiving an output from a turbine speed sensor operably coupled with a turbine rotor of a turbocharger, and indicating turbocharger degradation of the turbocharger based on the output. For example, the method may comprise detecting an axial position of the turbine rotor based on the output from the turbine speed sensor, and if the axial position is greater than a threshold distance from a base position, indicating the turbocharger degradation. In this way, turbocharger degradation may be determined based on output from a turbine speed sensor.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of detecting turbocharger degradation. The turbocharger includes a turbine with a turbine rotor, which is the rotating assembly of the turbine. The speed of a turbocharger may be monitored by a turbine speed sensor. However, the turbine speed sensor is exposed to high exhaust temperatures and, depending on the configuration of the sensor, is prone to failure. Failure of the turbine speed sensor may result in inaccurate indications of turbocharger degradation and unnecessary engine shut downs. To alleviate turbine speed sensor failure, the turbine speed may be monitored by a variable reluctance sensor, which has increased thermal capacity compared to standard speed sensors.

The variable reluctance sensor output is dependent on the radial air gap and axial position with respect to the turbine rotor. Thus, as the air gap increases in size and/or the axial position of the turbine rotor changes, the output of the sensor may decrease. In embodiments, a thrust collar is coupled to the turbine rotor; thus, a change in position of the thrust collar may be indicative of a change in position of the entire rotor. If the voltage output of the sensor decreases unexpectedly (e.g., below a designated value), an axial shift of the rotor may be indicated.

In one embodiment, the turbocharger may be coupled to an engine in a vehicle. A locomotive system is used to exemplify one of the types of vehicles having engines to which a turbocharger, or multi-turbocharger, may be attached. Other types of vehicles may include other types of rail vehicles, on-highway vehicles, and off-highway vehicles other than rail vehicles, such as mining equipment and marine vessels. Other embodiments of the invention may be used for turbochargers that are coupled to stationary engines. The engine may be a diesel engine, or may combust another fuel or combination of fuels. Such alternative fuels may include gasoline, kerosene, biodiesel, natural gas, and ethanol. Suitable engines may use compression ignition and/or spark ignition.

Figure 1:
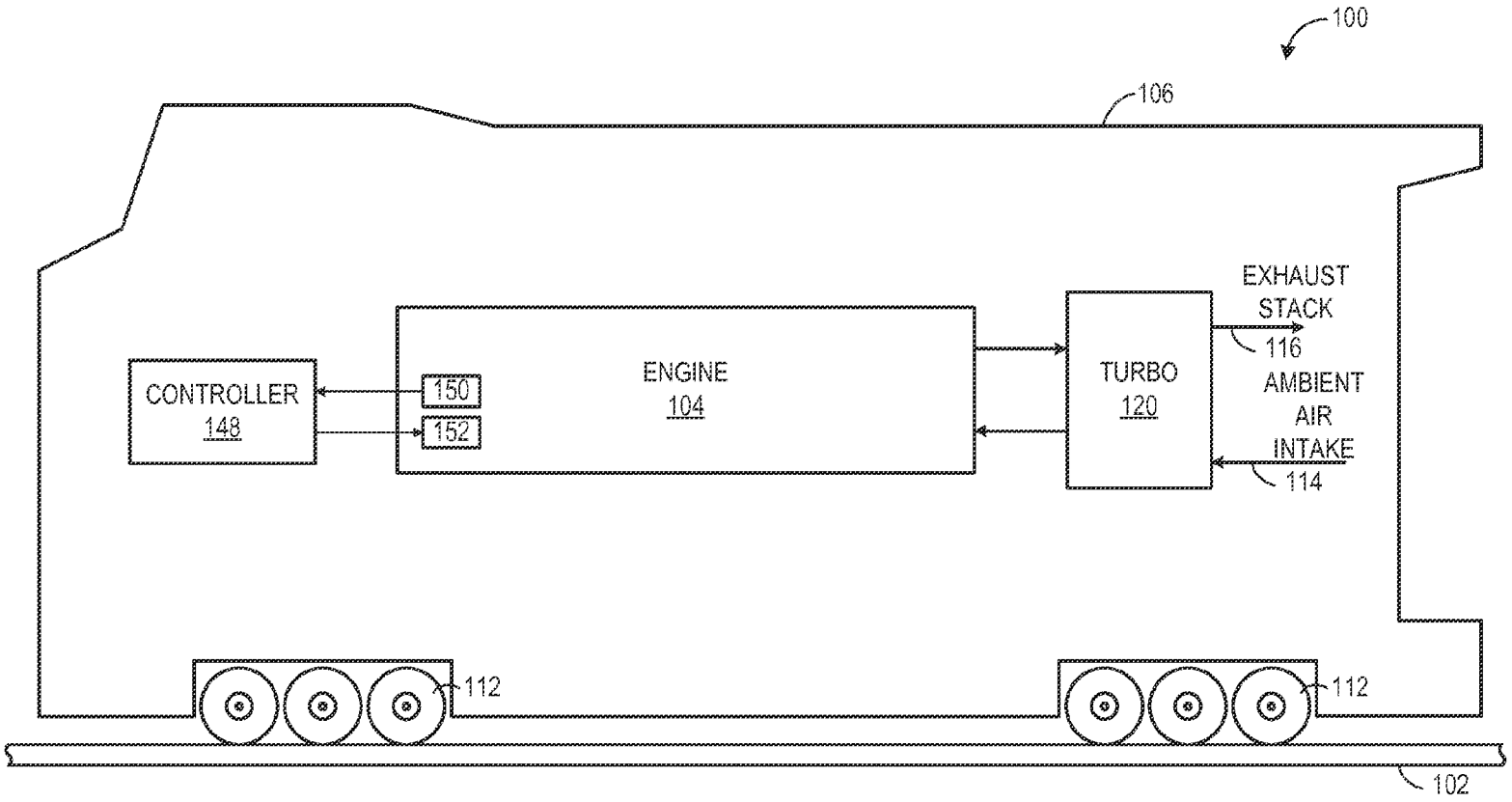
FIG. 1 shows an embodiment of a vehicle system.

FIG. 1 shows a block diagram of an exemplary embodiment of a vehicle system 100, herein depicted as a rail vehicle 106 (e.g., locomotive), configured to run on a rail 102 via a plurality of wheels 112. As depicted, the rail vehicle 106 includes an engine system with an engine 104.

The engine 104 receives intake air for combustion from an intake passage 114. The intake passage 114 receives ambient air from an air filter (not shown) that filters air from outside of the rail vehicle 106. Exhaust gas resulting from combustion in the engine 104 is supplied to an exhaust passage 116. Exhaust gas flows through the exhaust passage 116, and out of an exhaust stack of the rail vehicle 106.

The engine system includes a turbocharger 120 ("TURBO") that is arranged between the intake passage 114 and the exhaust passage 116. The turbocharger 120 increases air charge of ambient air drawn into the intake passage 114 in order to provide greater charge density during combustion to increase power output and/or engine-operating efficiency. The turbocharger 120 may include a compressor (not shown in FIG. 1) which is at least partially driven by a turbine (not shown in FIG. 1). While in this case a single turbocharger is shown, the system may include multiple turbine and/or compressor stages. The turbocharger is described in greater detail below with reference to FIG. 2.

In some embodiments, the vehicle system 100 may further include an exhaust gas treatment system coupled in the exhaust passage upstream or downstream of the turbocharger 120. In one example embodiment, the exhaust gas treatment system may include a diesel oxidation catalyst (DOC) and a diesel particulate filter (DPF). In other embodiments, the exhaust gas treatment system may additionally or alternatively include one or more emission control devices. Such emission control devices may include a selective catalytic reduction (SCR) catalyst, three-way catalyst, $NO_x$ trap, or various other devices or systems.

The rail vehicle 106 further includes a controller 148 to control various components related to the vehicle system 100. In one example, the controller 148 includes a computer control system. The controller 148 further includes computer readable storage media (not shown) including code for enabling on-board monitoring and control of rail vehicle operation. The controller 148, while overseeing control and management of the vehicle system 100, may be configured to receive signals from a variety of engine sensors 150, as further elaborated herein, in order to determine operating parameters and operating conditions, and correspondingly adjust various engine actuators 152 to control operation of the rail vehicle 106. For example, the controller 148 may receive signals from various engine sensors 150 including, but not limited to, engine speed, engine load, boost pressure, exhaust pressure, ambient pressure, exhaust temperature, turbine speed, etc. Correspondingly, the controller 148 may control the vehicle system 100 by sending commands to various components such as traction motors, alternator, cylinder valves, throttle, etc.

In one embodiment, the controller may include a communication system for reporting one or both of a turbine speed measurement device output or a determined degradation of the turbocharger based on an output of the speed measurement device, as will be described in greater detail below.

Figure 2:
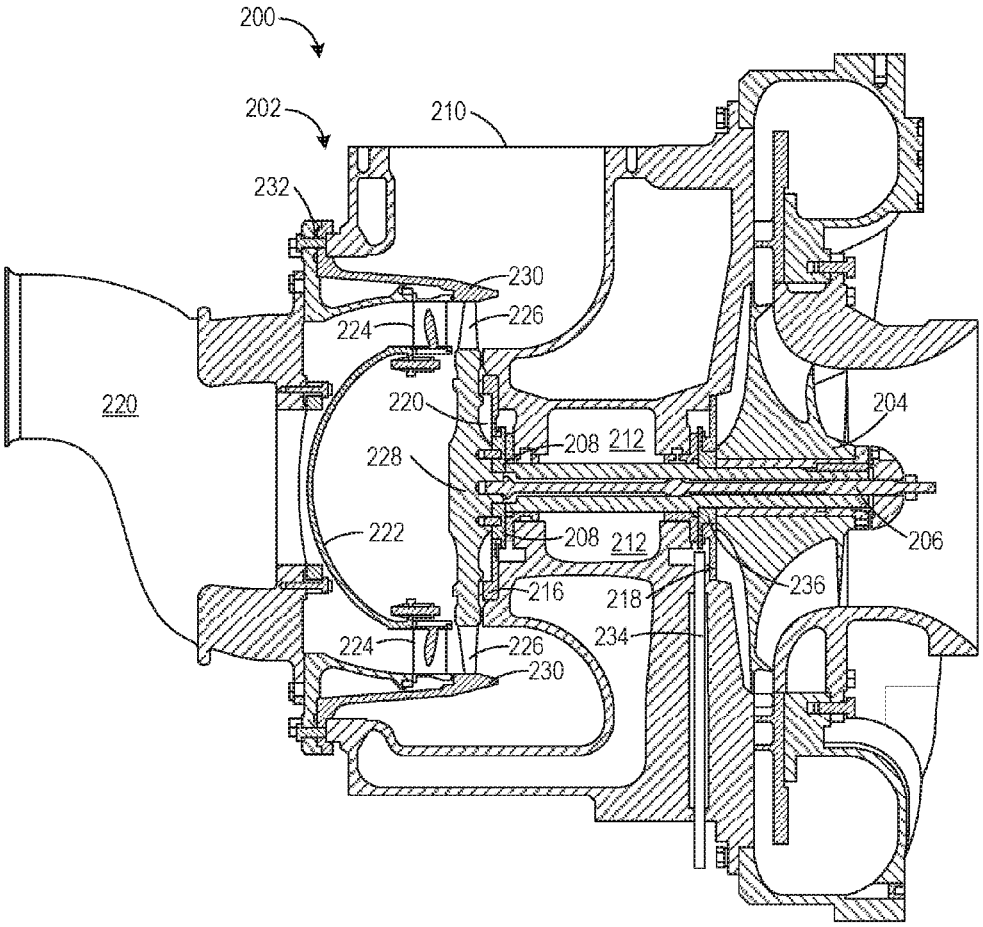
FIG. 2 shows an embodiment of a turbocharger that may be installed in the vehicle system of FIG. 1.

FIG. 2 shows an embodiment of a turbocharger 200 that may be coupled to an engine, such as turbocharger 120 described above with reference to FIG. 1. In one example, the turbocharger may be bolted to the engine. In another example, the turbocharger 200 may be coupled between the exhaust passage and the intake passage of the engine. In other examples, the turbocharger may be coupled to the engine by any other suitable manner.

The turbocharger 200 includes a turbine stage 202 and a compressor 204. Exhaust gases from the engine pass through the turbine stage 202, and energy from the exhaust gases is converted into rotational kinetic energy to rotate a shaft 206 which, in turn, drives the compressor 204. Ambient intake air is compressed (e.g., pressure of the air is increased) as it is drawn through the rotating compressor 204 such that a greater mass of air may be delivered to the cylinders of the engine.

The turbocharger includes a casing 210. In some embodiments, the turbine stage 202 and the compressor 204 may have separate casings which are bolted together, for example, such that a single unit (e.g., turbocharger 200) is formed. As an example, the turbocharger may have a casing made of cast iron and the compressor may have a casing made of an aluminum alloy.

The turbocharger 200 further includes bearings 208 to support the shaft 206, such that the shaft may rotate at a high speed with reduced friction. As depicted in FIG. 2, the turbocharger 200 further includes two non-contact seals (e.g., labyrinth seals), a turbine labyrinth seal 216 positioned between an oil cavity 212 and the turbine 202 and a compressor labyrinth seal 218 positioned between the oil cavity 212 and the compressor 204.

Exhaust gas may enter through an inlet, such as gas inlet transition region 220, and pass over a nose piece 222. A nozzle ring 224 may include airfoil-shaped vanes arranged circumferentially to form a complete 360° assembly. The nozzle ring 224 may act to optimally direct the exhaust gas to a turbine disc/blade assembly, including blades 226 and a turbine disc 228, coupled to the shaft 206. In some embodiments, the turbine disc and blades may be an integral component, known as a turbine blisk. The rotating assembly of the turbine, including the turbine disc, blades, and shaft, may collectively be referred to as the turbine rotor.

The blades 226 may be airfoil-shaped blades extending outwardly from the turbine disc 228, which rotates about the centerline axis of the engine. An annular shroud 230 is coupled to the casing at a shroud mounting flange 232 and arranged so as to closely surround the blades 226 and thereby define the flowpath boundary for the exhaust stream flowing through the turbine stage 202.

Turbocharger 200 may further include a speed sensor 234. Speed sensor 234 may be configured to determine a speed of the turbine rotor based on interaction between the speed sensor 234 and a notched or toothed wheel of the turbocharger. In the example illustrated in FIG. 2, speed sensor 234 is positioned adjacent to turbine thrust collar 236. Turbine thrust collar 236 may be annular shaped and substantially surround a portion of shaft 206. As such, thrust collar 236 may rotate with shaft 206. Thrust collar 236 may include a plurality of notches that, when in alignment with a central axis of speed sensor 234, cause an increase in the voltage output by speed sensor 234. Based on the frequency of this voltage output, the speed of the turbocharger may be determined.

Speed sensor 234 may be a variable reluctance sensor in one example. As such, speed sensor 234 may include a magnet at the face of the speed sensor positioned adjacent to thrust collar 236. As a notch or tooth of thrust collar 236 passes by the face of speed sensor 234, the amount of magnetic flux passing through the magnet may increase, resulting in an increased voltage signal. Other speed sensors are also possible, such as a Hall effect sensor.

The magnitude of the signal output by speed sensor 234 may be a function of the distance between the speed sensor 234 and thrust collar 236. Further, the magnitude of the signal may also be a function of the axial position of the thrust collar 236 relative to the central axis of the speed sensor 234. That is, if the central axis of the thrust collar is in alignment with the central axis of the speed sensor, the magnitude of the voltage output by the speed sensor may be at a maximum relative to the signal output by the sensor if the thrust collar shifts in the axial direction (e.g., to the left or to the right).

The dependence of the axial position of the thrust collar on the output of the speed sensor may be utilized to determine the axial position of the thrust collar, and in turn the rotating assembly of the turbocharger. During manufacture and/or installation of the turbocharger, the turbine rotor may be positioned in a base position. The base position of the turbine rotor may be the standard, non-degraded position of the rotor in which the turbine disc, shaft, bearings, collar, etc., are in a designated position for desired turbocharger efficiency and performance. If the axial position of the turbine rotor shifts out of the base position, degradation to the turbocharger and/or other vehicle components may occur if the turbocharger continues to operate. Thus, if a shift in the axial position of the rotor is detected, turbocharger operation may be disabled and/or engine operation may be ceased. Additional details regarding adjusting engine operation in response to turbocharger degradation will be presented below with respect to FIG. 4.

As explained above, the position of the turbine rotor may be determined by output from the turbine speed sensor. FIGS. 3A-3D illustrate example thrust collar geometries that may provide for speed sensor output optimized for detecting a shift in rotor axial position.

Figure 3A:
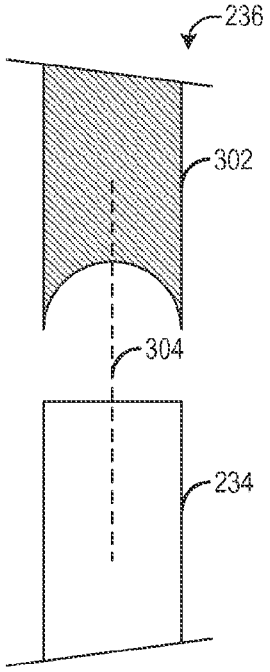
FIGS. 3A-3D illustrate various embodiments of thrust collar geometries.

Referring first to FIG. 3A, a cross-section of a portion of speed sensor 234 is illustrated. Specifically, the end of speed sensor 234 positioned proximate of the thrust collar 236 is shown. The end of the speed sensor 234 may include a magnet through which magnetic flux increases as the metal material of the thrust collar passes by the face of the speed sensor. Similarly, a cross-section of a portion of thrust collar 236 is also illustrated. Thrust collar 236 may include a tooth or notch 302 having a first geometry. Notch 302 may include a concave semi-circle structure at its outer circumferential edge. This concave geometry may be the result of an oil slinger of the thrust collar, for example.

When the rotor is in its base position, the center of the concave semi-circle is aligned with the central axis 304 of the speed sensor 234. If the axial position of the rotor shifts, the voltage output by the speed sensor may increase gradually as the outer circumferential edge of the notch becomes closer to the centerline of the speed sensor. Because the distance between the speed sensor and the notch may be optimized for detecting turbine speed when the rotor is in the base position (e.g., when the center of the semi-circle is aligned with the central axis 304), the signal output by the sensor may not increase by an amount sufficient to easily detect a shift in the turbine rotor axial position.

Figure 3B:
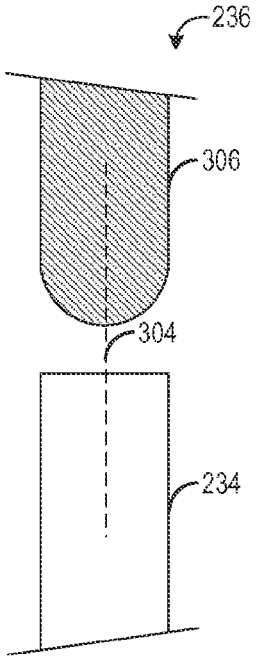
Figure 3C:
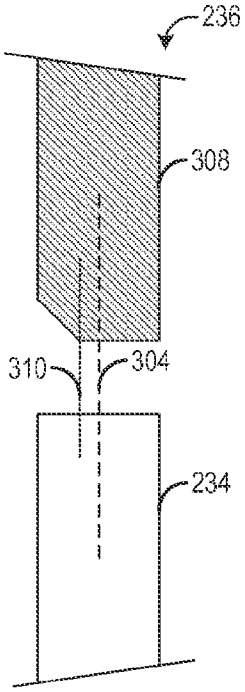
Figure 3D:
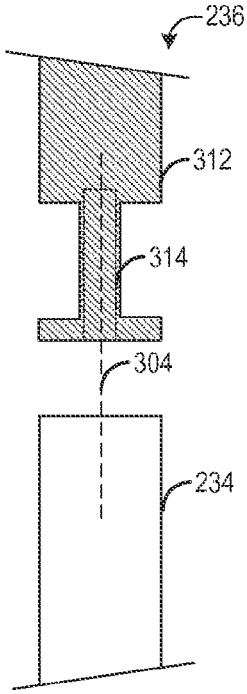

FIGS. 3B-3D illustrate modified thrust collar notch geometries adapted to cause the signal of the speed sensor to decrease in voltage when an axial shift in the rotor occurs. FIG. 3B illustrates a cross-section of a second embodiment of a notch 306 of the thrust collar 236. Notch 306 may include a convex curved semi-circle structure at its circumferential edge. Thus, the center of the semi-circle of notch 306 may be closer (e.g., a smaller vertical distance) to speed sensor 234 than the outer edges of the semi-circle. If the rotor shifts in the axial direction (e.g., to the left or to the right relative to the central axis of the speed sensor 234), the radial air gap between the notch 306 and the speed sensor 234 increases, thus causing a decrease in the voltage output by the speed sensor.

FIG. 3C illustrates a cross-section of a third embodiment of a notch 308 of the thrust collar 236. Notch 308 may include a notched-square structure at its circumferential edge. That is, the outer circumferential edge may be square, with a notched edge. Thus, the edge of the notch 308 that interfaces with the speed sensor 234 may be substantially the same distance from the speed sensor across its surface, other than the notched corner. If the rotor shifts in the axial direction (e.g., to the left or to the right relative to the central axis of the speed sensor 234), the radial air gap between the notch 308 and the speed sensor 234 remains the same until the start of the notched corner, which is denoted in FIG. 3C by line 310. Thus, if the axial position of the rotor shifts to or beyond a position where the start of the notched corner (e.g., line 310) aligns with central axis 304, the voltage output by the speed sensor will decrease. While FIG. 3C illustrates a notch 308 having a single notched corner, in some embodiments, both corners may be notched.

The distance between the center of the notch 308 (which aligns with the central axis 304 when the rotor is in its base position) and the start of the notched corner may be a function of a designated tolerance of the rotor. For example, the rotor may be allowed to shift in position by a small amount during turbocharger operation, without causing degradation to the turbocharger. Further, minor variations in turbocharger manufacture and installation may result in the center of the notch 308 being slightly out of alignment with the central axis 304, even when the rotor is in the base position. To account for these small movements and/or variations in turbocharger geometry, the notched corner may be spaced from the center of the notch 308 by a designated amount to provide rotor tolerance. In this way, the voltage output by the speed sensor may only decrease once the axial position of the rotor has moved beyond this designated amount.

Figure 5:
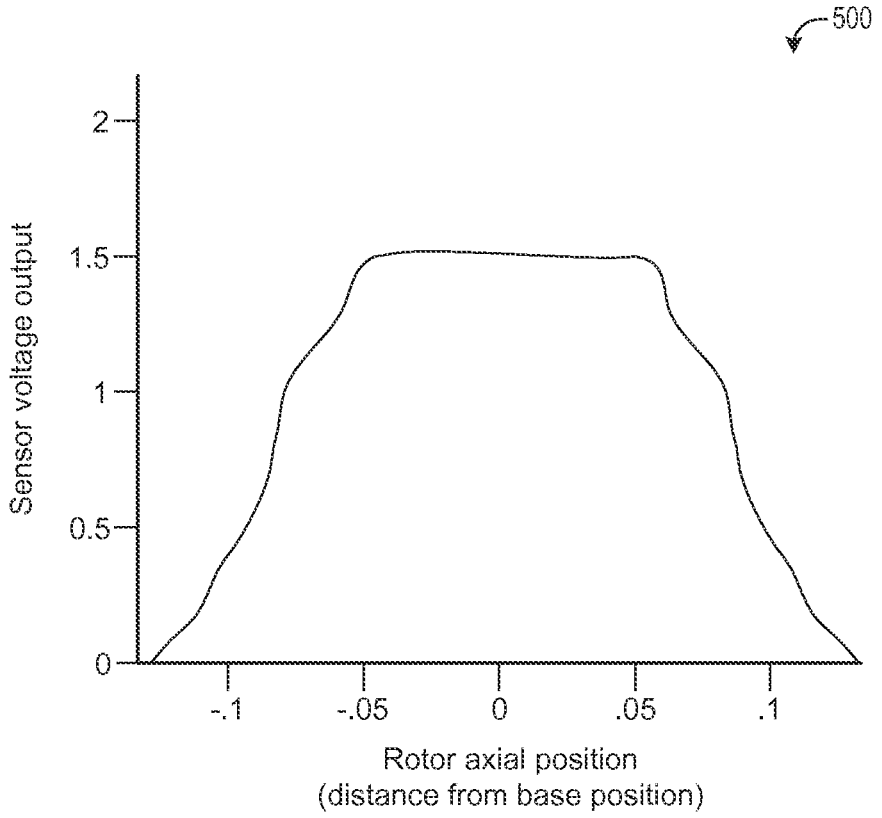
FIG. 5 is a diagram illustrating an example of turbine speed sensor voltage output as a function of turbine rotor axial position.

FIG. 5 illustrates a diagram 500 of an example of a voltage signal output by the speed sensor as a function of the axial position of the rotor. The diagram illustrated in FIG. 5 may be representative of a thrust collar geometry similar to that illustrated in FIG. 3C, with two notched corners each spaced approximately 0.05 cm from the center of the notch 308 of the thrust collar. The voltage signal output by the speed sensor may be a peak to peak signal collected while the turbocharger is operating at 600 RPM.

As shown in FIG. 5, the voltage output may remain substantially constant when the rotor is within a threshold distance of its base position (which may include being aligned with a central axis of the speed sensor). If the rotor shifts more than 0.05 cm from the base position, the voltage output by the sensor drops, due to the radial air gap increasing as the notched corner is centered over the speed sensor. Thus, the rotor axial position (relative to a base position) may be determined by the voltage output of the speed sensor.

Returning to FIG. 3D, it illustrates a cross-section of a fourth embodiment of a notch 312 of the thrust collar 236. Notch 312 may include an I-beam structure at its circumferential edge. The face of the notch 312 may be the same distance from speed sensor 234 regardless of the axial position of the rotor (unless the rotor shifts in position by a large enough amount to move the thrust collar entirely away from the speed sensor). However, the edge of the notch 312 may be configured with material that does not have equal ferrous density across the notch. For example, notch 312 may include a region 314 that has a maximum ferrous density relative to the remaining areas of the notch 312, with regions of lesser ferrous density surrounding region 314. Region 314 may be aligned with central axis 304 when the rotor is in its base position. Thus, due to the high ferrous density of region 314, when the rotor is in its base position, the voltage output by the speed sensor may be at maximum, and decrease as the region 314 shifts away from central axis 304.

Figure 4:
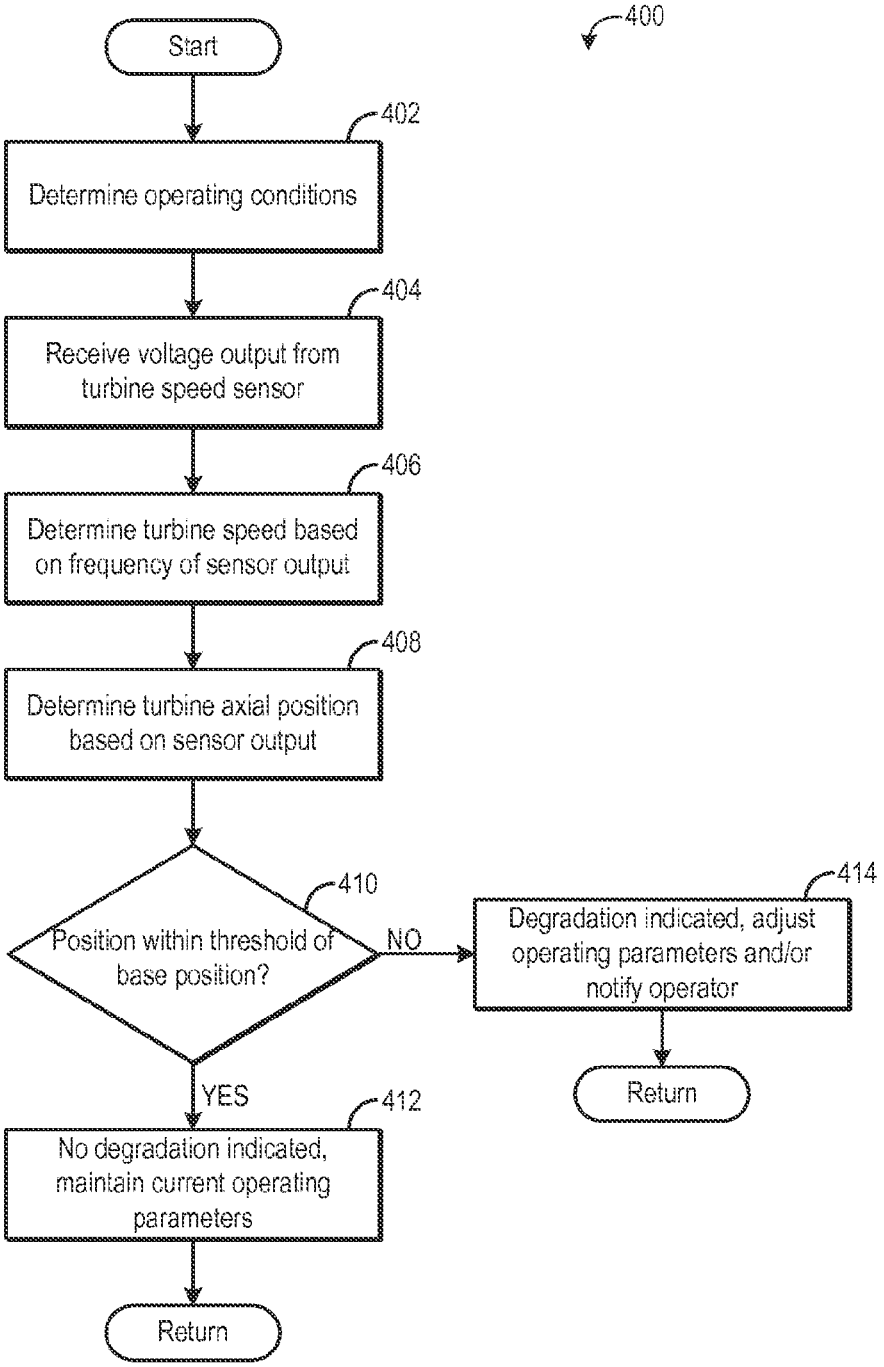
FIG. 4 is a flow chart illustrating a method for detecting turbocharger degradation according to an embodiment of the invention.

Turning now to FIG. 4, a method 400 for determining turbocharger degradation is indicated. Method 400 may be carried out by a controller, such as controller 148 of FIG. 1, to determine the axial position of a turbocharger rotor based on feedback from a turbine speed sensor, such as sensor 234.

At 402, engine operating parameters are determined. The engine operating parameters may include, but are not limited to, designated boost pressure, engine speed, and engine load. At 404, method 400 includes receiving voltage output from a turbine speed sensor. At 406, turbine speed is determined based on the frequency of the voltage output received from the speed sensor. In some embodiments, the turbine speed may be determined only if the turbocharger is engaged and/or rotating above a threshold speed, which may be estimated based on the engine speed, load, designated boost pressure, etc.

At 408, the axial position of the turbocharger rotor is determined based on the output of the speed sensor. As explained above with respect to FIGS. 2 and 3A-3D, the axial position of the rotor may affect the alignment of the turbine thrust collar with the speed sensor. When a central axis of the thrust collar is aligned with the central axis of the speed sensor, the voltage output by the speed sensor each time a notch of the thrust collar passes by the speed sensor may be a designated output. As the rotor shifts in the axial position, the voltage output may change (e.g., it may decrease). Thus, the axial position of the rotor may be determined based on the magnitude of the voltage output by the speed sensor.

At 410, it is determined if the axial position of the rotor is within a threshold distance of a base position of the rotor. As explained previously, the base position may be a designated position of the rotor for desired turbocharger performance. The threshold distance may be a suitable distance to allow for sufficient clearance between shaft thrust face and turbine journal thrust face, and small movement of the rotor may occur within this distance without causing turbocharger damage. In one example, the threshold distance may be 0.04 cm.

If it is determined at 410 that the rotor axial position is within the threshold distance of the base position, for example if the voltage output by the speed sensor is within a threshold voltage of a designated voltage, method 400 proceeds to 412 to indicate no degradation and maintain current operating parameters. However, if it is determined at 410 that the rotor axial position is not within the threshold distance of the base position, for example, if the voltage output by the speed sensor is greater or less than a designated voltage by more than a threshold amount, method 400 proceeds to 414 to indicate turbocharger degradation. This may include adjusting engine operating parameters and/or notifying a vehicle operator. For example, in some examples, engine operation may be ceased (e.g., automatically ceased) to prevent damage to the turbocharger or nearby components. In another example, the engine power may be de-rated (e.g., automatically de-rated). In doing so, the load on the turbocharger may be decreased, thus minimizing damage to the turbocharger while still allowing the vehicle to be operated. Method 400 then returns.

An embodiment relates to a method. The method comprises receiving an output from a turbine speed sensor operably coupled with a turbine rotor of a turbocharger, and indicating turbocharger degradation of the turbocharger based on the output. An axial position of the turbine rotor may be detected based on the output from the turbine speed sensor. The turbocharger degradation may be indicated if the axial position is greater than a threshold distance from a base position.

A position of a thrust collar coupled to the turbine rotor may be detected, where the thrust collar is aligned with the turbine speed sensor when the turbine rotor is in the base position. In embodiments, the output from the turbine speed sensor is a voltage output, and the position of the thrust collar is determined based on the voltage output from the turbine speed sensor.

The thrust collar may move out of alignment with the turbine speed sensor, and the movement of the thrust collar may be indicated if the voltage output from the turbine speed sensor is less than a designated voltage. A speed of the turbine rotor when the turbine rotor is in the base position may also be determined based on the output from the turbine speed sensor.

In embodiments, if turbocharger degradation is indicated, engine operation may be ceased. In embodiments, if turbocharger degradation is indicated, engine power may be derated.

The method may further include determining a turbine speed of the turbine rotor based on the voltage output of the speed sensor; and indicating the turbocharger degradation if the voltage output is less than a designated voltage. The turbine speed may be determined based on a frequency of a plurality of notches of a thrust collar of the turbocharger passing by the turbine speed sensor. The designated voltage may be a voltage output by the turbine speed sensor when one of the plurality of notches is passing by the turbine speed sensor and when a central axis of the thrust collar is aligned with a central axis of the turbine speed sensor.

The thrust collar may be coupled to the turbine rotor, and the turbocharger degradation may include an axial shift of the turbine rotor out of a base position. In embodiments, if turbocharger degradation is indicated, engine operation may be ceased. In embodiments, if turbocharger degradation is indicated, engine power may be derated.

An embodiment relates to a turbocharger system. The system comprises a turbine comprising a rotor, a thrust collar operably coupled to the rotor, a turbine speed sensor, and a controller. The controller is configured to determine an axial position of the thrust collar based on output from the turbine speed sensor, and if the axial position is greater than a threshold distance from a base position, indicate turbocharger degradation. The base position comprises a central axis of the thrust collar being in alignment with a central axis of the turbine speed sensor.

In embodiments, the thrust collar comprises an outer circumferential edge having a cross-section shaped as a semi-circle peak, and wherein the peak is aligned with the central axis of the turbine speed sensor when the axial position of the rotor is in the base position. In other embodiments, the thrust collar comprises an outer circumferential edge having a cross-section shaped as a notched square, and wherein an inner edge of a notch of the notched square is located at the threshold distance from the central axis of the thrust collar.

In embodiments, the thrust collar comprises an outer circumferential edge having a cross-section shaped as an I-beam having a maximum ferrous density in alignment with the central axis of the turbine speed sensor when the axial position of the rotor is in the base position.

The controller may be further configured to determine turbine speed based on interaction between the thrust collar and the turbine speed sensor. The thrust collar may comprise a plurality of notches, and the turbine speed may be determined based on a frequency of the notches passing by the turbine speed sensor.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method comprising:

detecting an axial position of a thrust collar coupled to a turbine rotor by converting output from a turbine speed sensor into a measurement of the axial position, the thrust collar including a tooth with an outer circumferential edge having a cross-section shaped as a notched square that is aligned with the turbine speed sensor when the turbine rotor is in a base position; and if the axial position is greater than a threshold distance from the base position, indicating turbocharger degradation.

2. The method of claim 1, wherein an inner edge of a notch of the notched square is located at the threshold distance from a central axis of the tooth of the thrust collar, the central axis of the tooth of the thrust collar configured to be aligned with a central axis of the turbine speed sensor when the turbine rotor is in the base position, where the central axis of the tooth of the thrust collar is perpendicular to a rotational axis of the turbine rotor, and where the central axis of the turbine speed sensor is perpendicular to the rotational axis of the turbine rotor and comprises a central longitudinal axis of the turbine speed sensor that passes through a face of the turbine speed sensor adjacent the tooth of the thrust collar.

3. The method of claim 2, wherein the output from the turbine speed sensor is a voltage output, and the position of the thrust collar is determined based on the voltage output from the turbine speed sensor.

4. The method of claim 3, wherein if the voltage output from the turbine speed sensor is less than a designated voltage, indicating the thrust collar has moved out of alignment with the turbine speed sensor.

5. The method of claim 2, further comprising determining a speed of the turbine rotor when the turbine rotor is in the base position, based on the output from the turbine speed sensor.

6. The method of claim 1, further comprising ceasing engine operation if turbocharger degradation is indicated.

7. The method of claim 1, further comprising derating engine power if turbocharger degradation is indicated.

8. A turbocharger system, comprising:

a turbine comprising a rotor;

a thrust collar coupled to the rotor, the thrust collar comprising a tooth with an outer circumferential edge having a cross-section shaped as a notched square;

a turbine speed sensor; and a controller configured to:

convert output from the turbine speed sensor into a measurement of an axial position of the thrust collar; and if the axial position is greater than a threshold distance from a base position, indicate turbocharger degradation.

9. The system of claim 8, wherein the base position comprises a central axis of the tooth of the thrust collar being in alignment with a central axis of the turbine speed sensor, where the central axis of the tooth of the thrust collar is perpendicular to a rotational axis of the rotor, and where the central axis of the turbine speed sensor is perpendicular to the rotational axis of the rotor and comprises a central longitudinal axis of the turbine speed sensor that passes through a face of the turbine speed sensor adjacent the tooth of the thrust collar.

10. The system of claim 9, wherein an inner edge of a notch of the notched square is located at the threshold distance from the central axis of the tooth of the thrust collar.

11. The system of claim 8, wherein the controller is further configured to determine turbine speed based on interaction between the thrust collar and the turbine speed sensor.

12. The system of claim 11, wherein the thrust collar comprises a plurality of teeth, and wherein the turbine speed is determined based on a frequency of the teeth passing by the turbine speed sensor.

13. A method, comprising:

determining a turbine speed of a turbine based on a frequency of a plurality of teeth of a thrust collar of the turbocharger passing by a turbine speed sensor as determined by a voltage output of the turbine speed sensor when the thrust collar is in a base position, at least one tooth of the plurality of teeth including an outer circumferential edge having a cross-section shaped as an I-beam having a region of maximum ferrous density in alignment with a central axis of the turbine speed sensor when the thrust collar is in the base position, where the central axis of the turbine speed sensor is perpendicular to a rotational axis of a rotor of the turbine and comprises a central longitudinal axis of the turbine speed sensor that passes through a face of the turbine speed sensor adjacent the thrust collar; and if a magnitude of the voltage output of the turbine speed sensor is less than a designated voltage, indicating turbocharger degradation.

14. The method of claim 13, wherein the designated voltage is a voltage output by the turbine speed sensor when the at least one tooth of the plurality of teeth is passing by the turbine speed sensor and when the region of maximum ferrous density is aligned with the central axis of the turbine speed sensor.

15. The method of claim 14, wherein the turbocharger degradation comprises an axial shift of the rotor out of a base position.

16. The method of claim 13, further comprising ceasing engine operation if turbocharger degradation is indicated.

17. The method of claim 13, further comprising derating engine power if turbocharger degradation is indicated.

* * * * *